US007243500B2

(12) United States Patent
Cowans et al.

(10) Patent No.: US 7,243,500 B2
(45) Date of Patent: Jul. 17, 2007

(54) HEAT EXCHANGER AND TEMPERATURE CONTROL UNIT

(75) Inventors: Kenneth W. Cowans, Fullerton, CA (US); William W. Cowans, Fullerton, CA (US); Glenn W. Zubillaga, Canyon Lake, CA (US)

(73) Assignee: Advanced Thermal Sciences Corp., Anaheim, CA (US)

( * ) Notice: Subject to any disclaimer, the term of this patent is extended or adjusted under 35 U.S.C. 154(b) by 103 days.

(21) Appl. No.: 11/137,686

(22) Filed: May 26, 2005

(65) Prior Publication Data

US 2005/0269067 A1 Dec. 8, 2005

Related U.S. Application Data

(60) Provisional application No. 60/576,706, filed on Jun. 2, 2004.

(51) Int. Cl.
*F25B 41/00* (2006.01)
*F28F 1/36* (2006.01)

(52) U.S. Cl. ..... 62/196.4; 62/197; 165/184

(58) Field of Classification Search ..... 62/196.4, 62/197; 165/177, 180, 183, 184
See application file for complete search history.

(56) References Cited

U.S. PATENT DOCUMENTS 4,065,264 A * 12/1977 Lewin ..... 422/46
4,348,794 A * 9/1982 Kim et al. ..... 29/890.036
4,739,634 A * 4/1988 Watanabe ..... 62/51.1
4,918,938 A * 4/1990 De Forest et al. ..... 62/238.6
5,228,505 A * 7/1993 Dempsey ..... 165/140
5,339,654 A * 8/1994 Cook et al. ..... 62/476
6,804,965 B2 * 10/2004 Abras ..... 62/3.7

* cited by examiner

*Primary Examiner*—Marc Norman
(74) *Attorney, Agent, or Firm*—Jones, Tullar & Cooper, P.C.; Raymond A. Bogucki

(57) ABSTRACT

Systems and methods for heat exchange in accordance with the invention define adequately long-interchange distances for two fluids by wrapping a tube containing a first fluid about the wall of an inner cylindrical tank, within a gap formed with a second concentric tank. A second fluid is transmitted in the space defined between the turns of the tube and the two walls, providing effective short length thermal interchange through the tube walls. The tube is in the line contact with both tank walls and the fluids can flow rapidly over an adequately long length, so that high efficiency is provided in a low cost system.

16 Claims, 7 Drawing Sheets

(SECTION A-A)

SECTION C-C

HEAT EXCHANGER AND TEMPERATURE CONTROL UNIT

This invention relies for priority on a previously filed provisional patent application Ser. No. 60/576,706 filed Jun. 2, 2004 by Kenneth W. Cowans, William W. Cowans and Glenn W. Zubillaga.

FIELD OF THE INVENTION

This invention relates to heat exchanger systems and to temperature control units which use such systems, with the objective of providing more efficient, compact, economical and versatile heat exchange functions.

BACKGROUND OF THE INVENTION

The tremendous variety of heat exchangers that is currently available is actually insufficient to satisfy the needs and goals of current developments and technology. The heat exchangers available include many metal, plastic and other configurations in which thermal energy is transferred between different liquids, between gases and liquids, between liquid/vapor fluids and liquids, and between other combinations of media. Such heat exchangers are used for cooling or heating or both purposes.

As the art has developed, however, increasing demands have been made on the heat exchangers and the temperature control units that utilize them, in terms of efficiency, size and particularly cost. For example, in semiconductor fabrication facilities controlling the temperature of a cluster tool may require that different temperature levels be established and closely maintained in different modes of operation. Since floor space in such installations is very expensive, the footprint of the temperature control unit should be as small as feasible. In addition, the unit should operate reliably for long periods so as not to impede or interrupt tool or overall system operation. The emphasis on lowering cost applies not only to labor and materials but to fabrication techniques. The design should also permit the alternative incorporation of a pump or heater. The present system has been devised as a radically different approach in hardware and method having many potential applications not only in this context, but also in a variety of other applications.

SUMMARY OF THE INVENTION

Heat exchanger units in accordance with the invention transport a temperature controlled gas or liquid, or mixture thereof, at substantial velocity in intimate and uninterrupted relation with respect to a moving thermal transfer fluid that is to be used for temperature control, as in a semiconductor fabrication facility. To this end, thermal transfer fluid is directed in a confined but unrestricted helical path at a radius about a central axis, while a variable temperature fluid or gas, such as a refrigerant, is flowed coextensively and continuously in an adjacent helical path in either a parallel or a counter-flow direction. The cross-sectional areas of both flows are small but the fluids may flow at substantial velocities over paths which are arbitrarily long. The heat transfer distances between the fluids in contrast can be very short through the tubing walls, affording high efficiency operation.

The flow paths are preferably established between two concentric tanks spaced apart by a small distance, within which refrigerant tubing is disposed in a helical geometry about the central axis. Thermal transfer fluid flows in the spaces between the turns of the tubing and the cross-sectional areas of the two flows are small. Thus there is intimate thermal interchange between the two fluids throughout long path lengths and minimal if any thermal losses along the paths. The interior of the tanks provides a volume which may include an impeller for driving thermal transfer fluid and a heater element for energy additive or corrective purposes. Refrigerant flow is driven by pressure from a compressor in a conventional vapor-cycle system but minimal flow impedance is introduced.

This system may use a liquid refrigerant after compression and condensation, or the refrigerant as a pressurized hot gas after compression but without condensation. Pressurized refrigerant after condensation will be in a liquid/vapor mix in which the temperature is controlled by an expansion valve. Modern molding techniques and assembly techniques can be used in manufacture of the tanks, so the containers can be of low cost materials and precisely reproducible in quantity. Whether cooling or heating, the thermal transfer fluid can regulate temperature efficiently and precisely, and if cooling and heating are both used, a wide temperature range can be established with an electronic controller system.

In a more particular example of this versatile heat exchanger, a helical ridge about the periphery of the inner tank provides a guide and support structure for the encircling refrigerant tubing that intimately engages both of the opposite walls in line contact. The refrigerant flow exits from the double cylinder configuration via a vertical tubing parallel to the central axis, for return to the associated refrigeration system. The thermal transfer fluid that is fed into the helical path between the cylinders also fills the interior volume, advantageously through a flow-control pipe extending up from the bottom which encompasses an electrical heater element depending from the top of the tank unit insuring that the heater is immersed in fluid. A multi-stage impeller extending down into the interior of the inner tank from a drive motor on the tank top wall is advantageously employed to drive the thermal transfer fluid. The thermal transfer fluid flows from an input at the side, through the helical path within the gap between the tank walls, then through the interior tank volume to the pump inlet and thence to an outlet port in the top wall about the pump axis. An orifice is included at a point along the thermal transfer fluid loop in a position to release any air in the fluid.

Methods in accordance with the invention have a number of different aspects. The long and confined but unrestricted flow of fluid at substantial velocities assures that effective thermal exchange occurs over an adequately long path length and large surface area. This occurs without leakage of fluid or thermal energy between the turns along the flow paths. Thermal energy is transferred over short distances between the two fluid flows, which are of small cross-sectional areas. Assembly of the tanks relative to the helical refrigerant tubing uses the flexibility of the unstressed tubing to position the tubing against the helical ridge on the outside of the inner tank. The refrigerant tubing is also tensioned into firm and precise position between the two tank walls, maximizing thermal exchange efficiency without the need for high precision machining.

BRIEF DESCRIPTION OF THE DRAWINGS

A better understanding of the invention may be had by reference to the following description, taken in conjunction with the accompanying drawings in which.

DETAILED DESCRIPTION OF THE INVENTION

Figure 1:
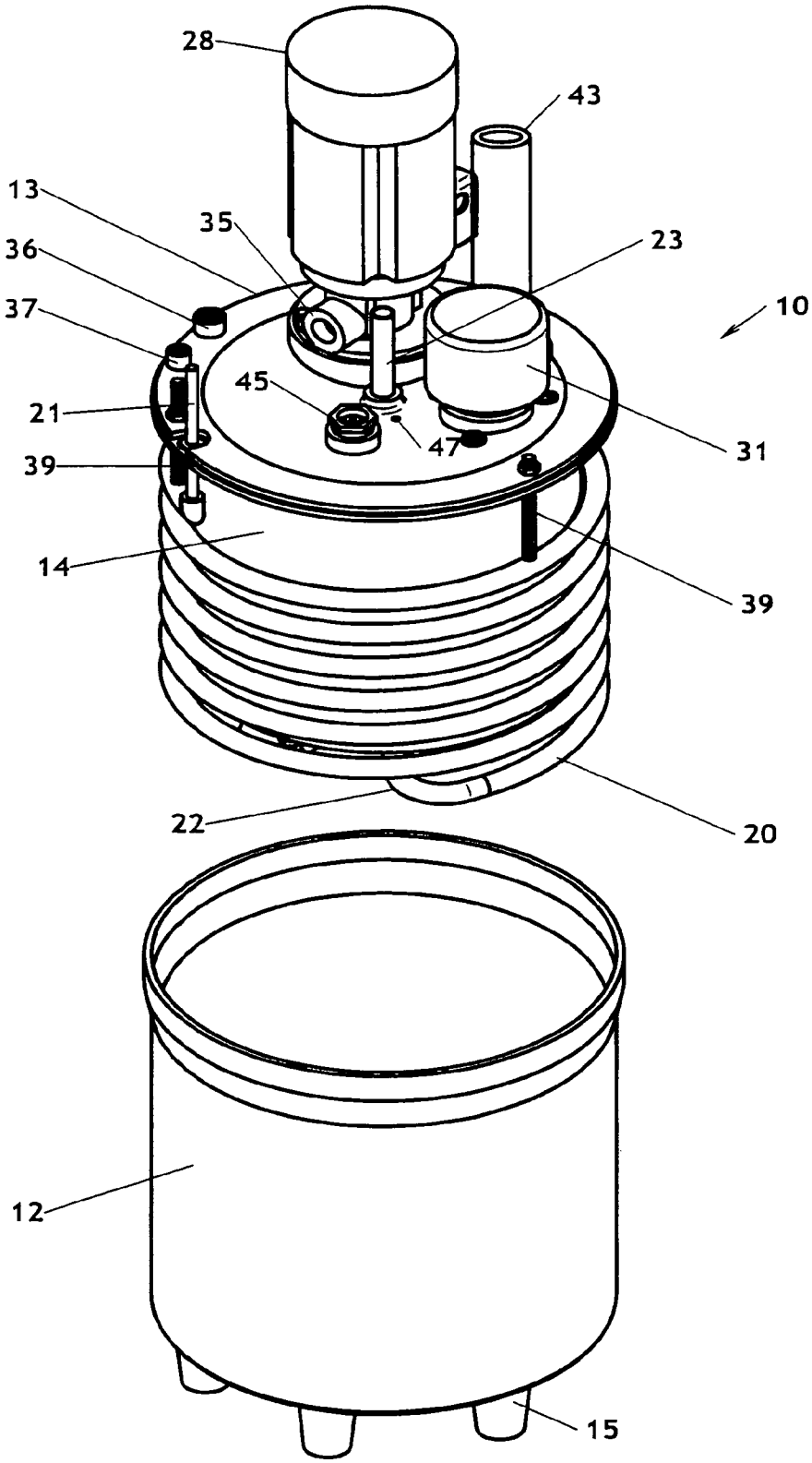
FIG. 1 is a perspective view, in exploded form, of a heat exchanger system in accordance with the invention.

FIGS. 1-9 are perspective and cross-sectional views of a heat exchanger 10 in accordance with the invention, utilizing a volumetric arrangement including an outer tank 12 of generally cylindrical form. The outer tank 12 has a closed bottom wall and a top edge with a circumferential rim enclosed by a top plate 13. A radial space of predetermined size, established generally by the diametral dimensions of a refrigerant tubing to be inserted between them, is established between the inner wall of the outer tank 12 and the outer wall of an inner tank 14 which is concentric therewith and nested therein. The radial gap is slightly greater than ¾" in this example. The tanks 12, 14 are generally concentric about a central axis (shown vertical in the Figures), and the unit rests on a number of hollow feet 15 in the bottom walls. The feet 15 may be filled with foam or otherwise internally filled.

Figure 3:
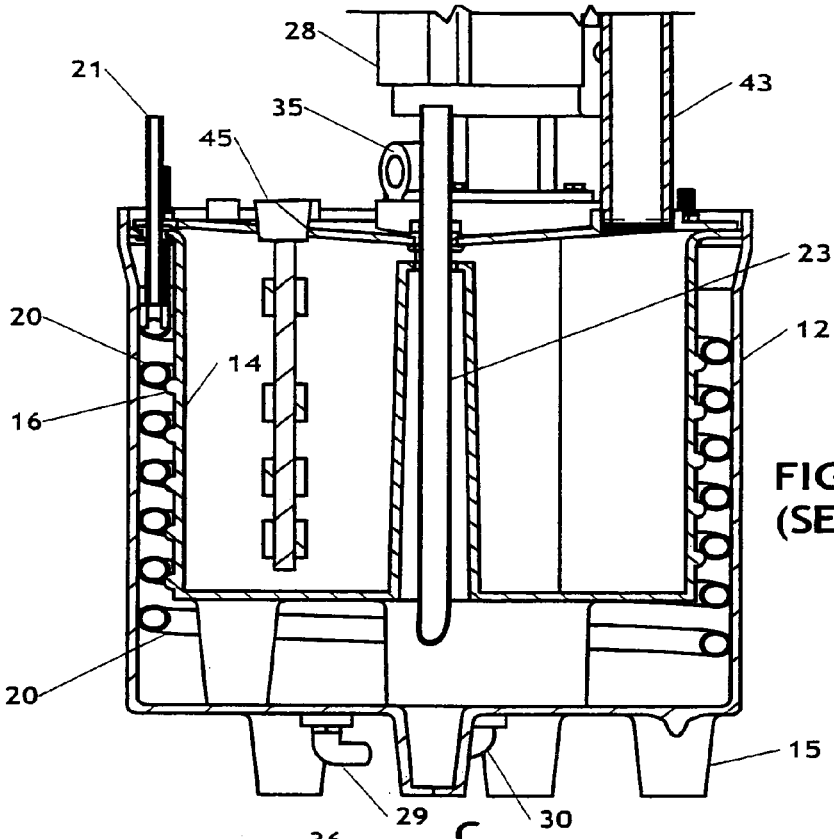
FIG. 3 is a simplified cross-sectional view of the system of FIG. 1, taken along the section line A-A in FIG. 2.
Figure 5:
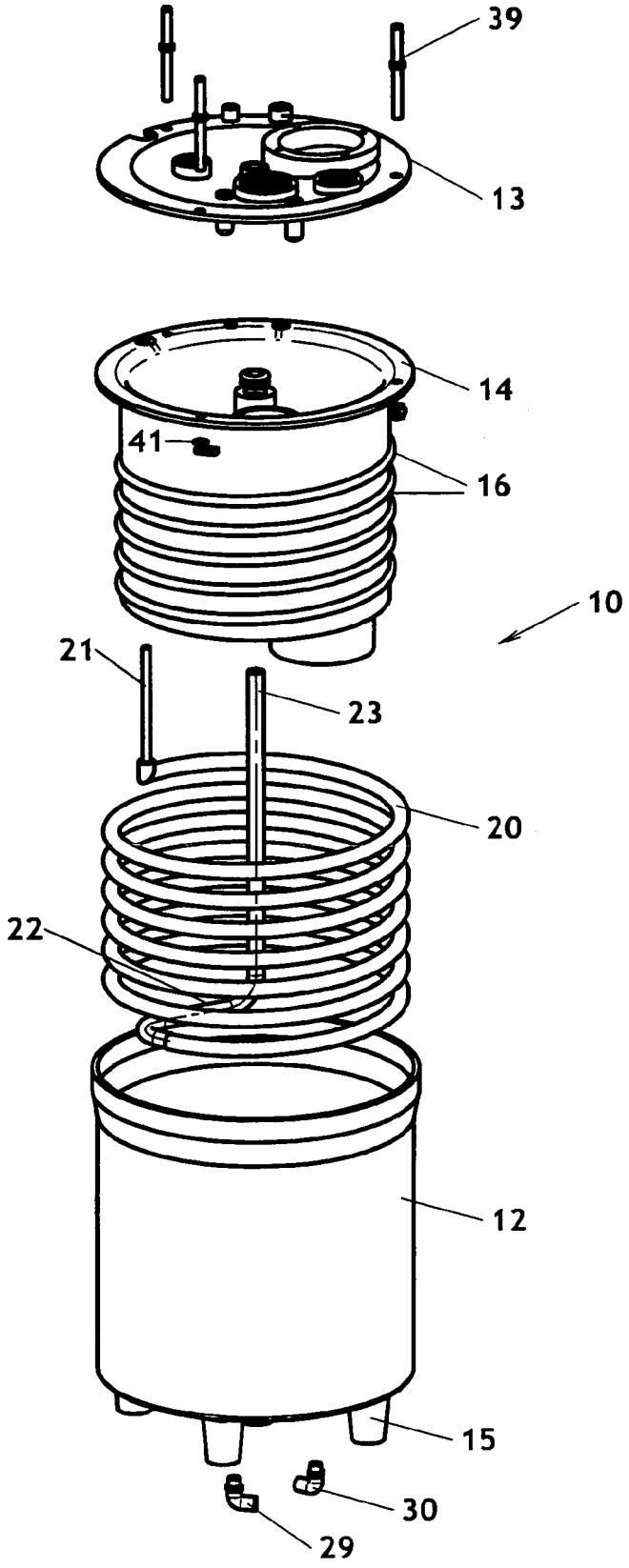
FIG. 5 is an exploded perspective view of the system, showing the double tank arrangement and conduits in further detail.

The outer surface of the inner tank 14 includes a helical peripheral ridge 16 that extends continuously from approximately the top to bottom about the tank 14. The ridge 16 is shaped as a rounded triangular form in cross-section and has a pitch p (FIGS. 5 and 7) between successive turns that also defines the vertical spacing between turns of the refrigerant tubing 20 helix, as described below. The top surface of the ridge 16 throughout its length defines a seating surface for a small arc of the outer surface of the adjacent helical tubing 20 segment. In position on the ridge 16, the tubing 20 thus angles gradually downwardly in a helical path from an inlet port where a stiffened inlet section 21 (FIG. 3) of the tubing enters through the top plate 13. The inlet section 21 and port also provide a circumferential positional reference for the somewhat compliant tubing turns when assembling the tubing 20 between the two tanks 12, 14 in accordance with the method described in relation to FIG. 10 below. Referring to FIGS. 1, 3 and 5, particularly, the helical tubing 20 descends about the inner tank 14 to a lower-most turn, at which a transition section 22 (FIGS. 1 and 5) leads radially inwardly to the bottom of a vertical output line 23 that extends up through the top plate 13 and out the heat exchanger system.

The tanks 12, 14 and the refrigerant tubing 20 are sized so that the tubing 20 when properly tightened wedges between the outer tank wall and against the upper surface of the helical ridge 16 throughout the vertical span along the tanks. The tubing 20 firmly contacts and seats against both these generally opposing surfaces with line contact. In this example, the tubing 20 has an outer diameter of 0.75" and the pitch (p) is about 1.75".

Figure 4:
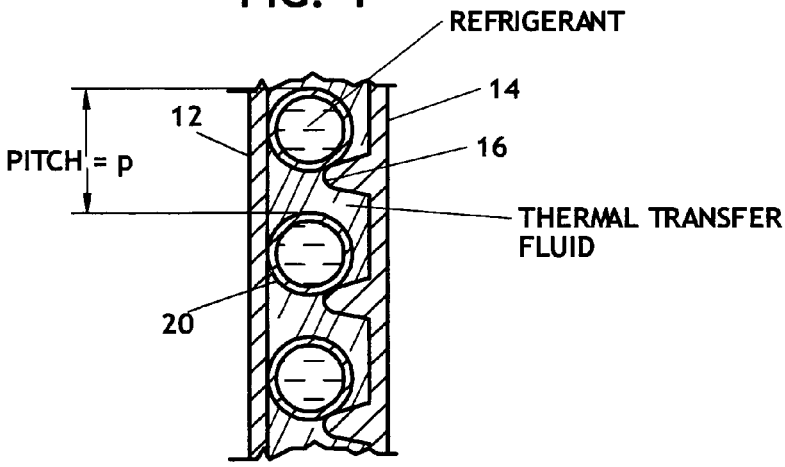
FIG. 4 is a simplified and fragmentary view of a small enlarged segment of the system showing of the relative flow paths of refrigerant and thermal transfer fluid in the system of FIGS. 1-3.

As seen in FIG. 4, the successive turns of the helical tubing 20 and the facing sides of the tanks 12, 14 define a four sided cross-sectional area for the thermal transfer fluid, with two sides flat (the tank walls) and two sides concave (defined by the convex tubing exteriors). This cross-sectional area is greater than the internal cross-sectional area of the tubing 20, but both are small. For the configuration shown, the flow area is being less than 0.50 $in^2$ for the tubing 20 and less than 1.00 $in^2$ for the space between the tubing turns and their walls. The lengthwise flow paths, on the other hand, will be more than 20 feet long for each of the fluids, and can be of almost arbitrary length.

The thermal transfer fluid typically has both a high boiling point and a very low freezing point. It is very common for these applications to use a proprietary fluid named "Galden", which has the needed boiling and freezing properties and a flowable viscosity throughout its temperature range. Mixtures which have similar properties, such as ethylene glycol (a typical antifreeze) and distilled water, may also be used. The particular thermal transfer fluid that is chosen is a matter of choice for the particular installation. For many less demanding heat exchange applications a specialized thermal transfer fluid may not be needed.

FIGS. 1, 3, 4 and 6 show the thermal transfer fluid path and flow direction, starting with an inlet port 36 (FIGS. 1 and 7) in the top plate 13 which leads into the gap between the tank walls and the tubing 20 turns. The thermal transfer fluid also flows helically between the tubing 20 turns at an angle downwardly to the bottom level within the outer tank 12. The fluid flow at the bottom first enters the open base of a vertical flow tube 25 (FIG. 6) which is offset from the central axis and forms a separate chamber that is also spaced apart from top plate 13 at its upper end, so that fluid can spill over into the main interior volume. When the fluid level fills up the flow tube 25 to the top, the fluid spills outwardly through the upper gap between the flow tube 25 and the top plate 13 and pours into the main cavity of the inner tank 14. It next fills the inner tank 14 interior, including the volume below an axial pump motor 28 that is mounted on the top plate 13. The pump system includes multiple stages of pumping impeller elements 27 which extend down into the interior of the inner tank 14. The pump impeller 27 and motor 28 may advantageously be of a type of multistage centrifugal pump that is made by Grundfos of Germany. This pump impeller 27 may, for example, have 12 stages, each stage driving the fluid to a successively higher level until the ultimate output stage level is reached at the top position and the fluid exits via a radial output port 35 (best seen in FIGS. 1 and 2). The bottom of the outer tank 12 includes a pair of drain ports 29, 30 in which removable plugs are threaded to allow draining of liquid from within the tanks 12, 14.

Figure 2:
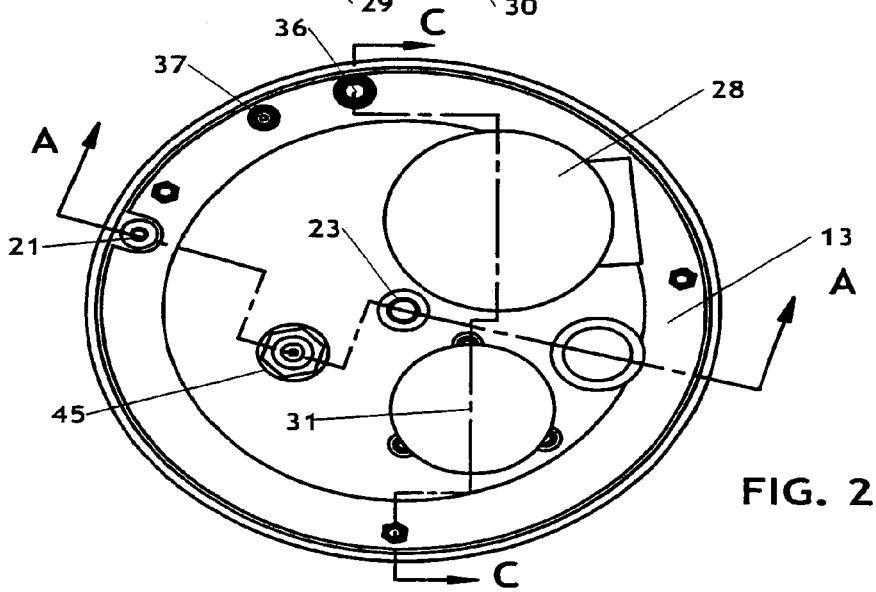
FIG. 2 is a top view of the heat exchanger of FIG. 1 showing section lines A-A and C-C for reference.
Figure 9:
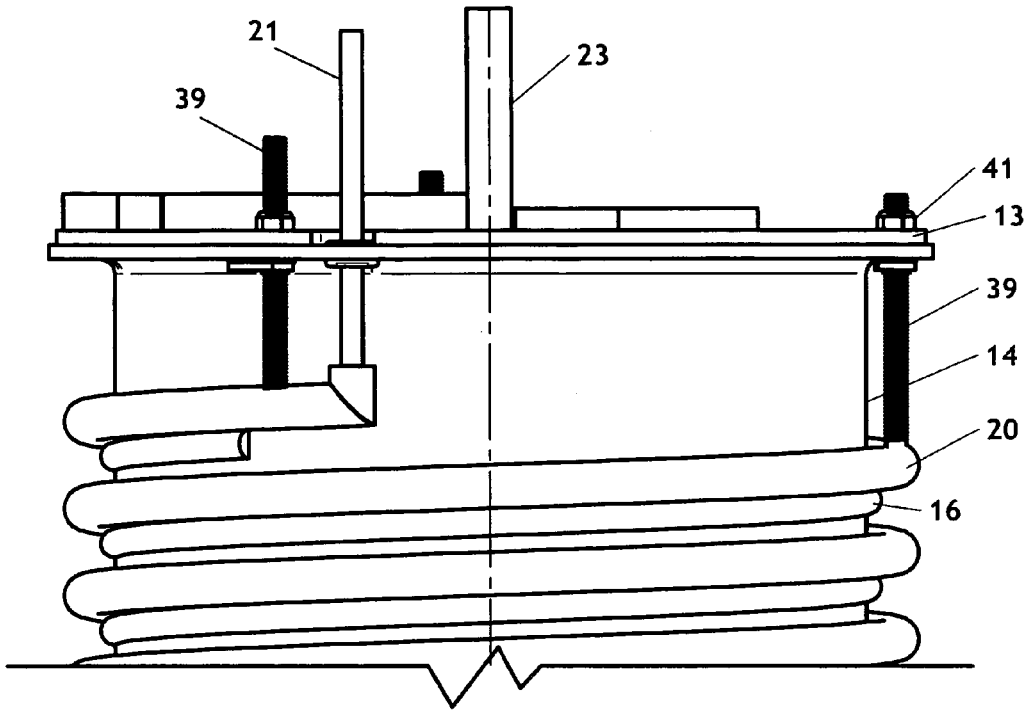
FIG. 9 is a perspective fragmentary view of the top plate, inner tank, helical tubing and threaded studs for coupling the elements together.

Referring to FIG. 2 the core 32 of an optional electrical heater 31 is also advantageously mounted (though a heater may not be required) on the top plate 13. The heater core element 32 extends down into the flow tube 25. The core 32 is assuredly immersed once circulation of thermal transfer fluid begins. When the core 32 is energized it heats the surrounding fluid with high efficiency. The heater 31 is selected to provide sufficient power, e.g. 1250 watts, to heat the fluid to a predetermined maximum temperature level, when in the heating mode. The heater may also be used to adjust output temperature more precisely if the associated process tool is below a desired level. The flow tube 25 isolates the heater 31 from the stages of the axial pump impeller 27 as well as insuring that the heater element is encompassed by fluid.

Flow-paths in the top plate 13 about and concentric with the pump axis 27 lead into the radial output port 35 (FIGS. 1 and 3) just above the top plate 13. The input conduit 36 for the thermal transfer fluid feeds into the gap between the two tanks 12, 14 at one circumferential position, here spaced apart from the inlet tube 21 for the refrigerant.

Consequently, assuming here that the heater element 31 and the pump impeller 27 are both energized, operation commences by input of the thermal transfer fluid into the gap between the tanks 12, 14 to flow helically around the gap between the turns of the refrigerant tubing 20. Concurrently refrigerant is fed into the input line 21 to the tubing 20 leading through the top plate 13 and flows helically in parallel paths adjacent to the thermal transfer fluid flow paths. Since the thermal transfer fluid moves helically within the gap defined by adjacent tubing 20 turns and the opposing tank walls there is only a short, heat conductive, tubing wall between the two fluids. Efficient thermal interchange through the short path of the tubing 20 wall heats or chills the thermal transfer fluid with the refrigerant in accordance with the temperature setting for the system. No meaningful leakage path exists between the tubing 20 and the inner tank 14 on one side and the tubing 20 and the inner wall of the outer tank 12 on the other, because the diametral size of the refrigerant tubing 20 fits closely to the gap, and the assembly method used tightens the tube 20 against both inner and outer surfaces. Cross-leakage of thermal transfer fluid between the turns therefore does not introduce significant heat energy losses.

Thermal energy interchange and efficiency are facilitated by the substantial velocities of the two fluids. In the tubing 20, the refrigerant is in a liquid-vapor state, and transported at a mass flow rate, in one practical example, of 100 g/sec. The thermal transfer fluid is, in the same example, transported at about 100 cm/sec. The example is based on use of a 3 HP compressor and a thermal transfer fluid flow of 2-15 gal/min. The flow rates are sufficient to ensure flow turbulence, enhancing thermal interchange.

The preferred arrangement for filling the inner tank 14 is to pour thermal transfer fluid in via an upstanding fill port 43 that extends down, into the interior volume. The fluid level may be observed at a sight gauge (not shown) or measured by the signal from a level indicator 45 located extending into the interior from the top plate 13. The fill port 43 is then closed off during circulation of the thermal transfer fluid.

Alternatively, the tank 14 can be filled by normal input flow so that when the thermal transfer fluid reaches the bottom level of the tanks 12, 14, within the outer tank, it first fills the flow tube 25, then spills over the top of the flow tube 25, pouring into the major portion of the interior volume. With some fluid at least partially filling the inner volume, the heater 31 can be turned on, and then the pump 27 can drive thermal transfer fluid upwardly toward the outlet apertures 42 in the top wall 13 and the outlet port 43. Alternatively, if the tanks fill sufficiently rapidly, the pump 27 can be turned on at the outset and delay can be tolerated without overheating the pump, or the pump chosen can be of a design which does not require cooling.

A bleed hole 47 (FIG. 1) in the uppermost part of the top wall 13 of the inner tank 14 allows air in the thermal transfer fluid to escape into the main volume as the system fills, and precludes air entrapment in the space between the inner and outer walls. Orifices for this purpose may be placed elsewhere to eliminate an air entrapment condition.

In contrast to the thermal transfer fluid, the refrigerant need not be separately pumped because the pressurization provided by the compressor in the system drives the refrigerant, via the inlet 21, down through the helical tubing 20. The flow continues through the turns of tubing until the exit section 22 at the bottom leads to the vertical outlet riser 23 forming the exit path along one circumferential side of the inner tank 14, from where the refrigerant flows outwardly to return to the compressor in the system.

Figure 7:
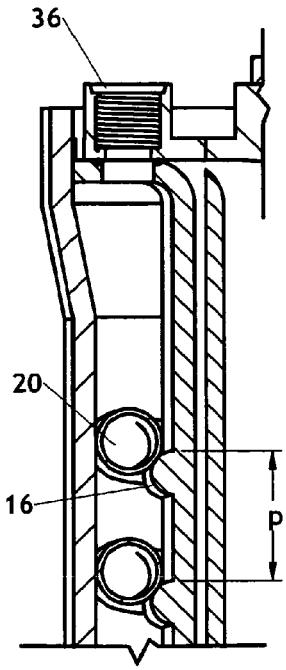
FIG. 7 is an enlarged fragmentary view of a portion of the system as seen in FIG. 6, showing some of the inlet details of the inlet for thermal transfer fluid.
Figure 8:
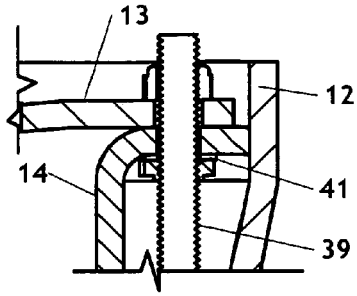
FIG. 8 is a fragmentary view of a portion of the system as seen in FIG. 6, showing details of how the tanks are attached together and to the top plate.
Figure 6:
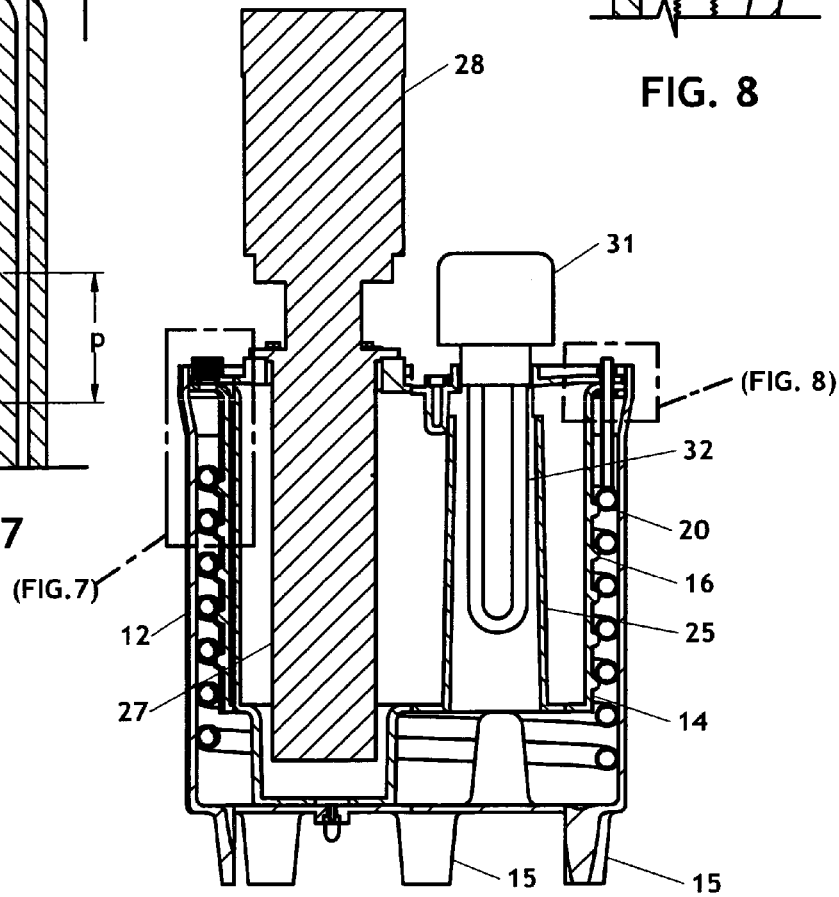
FIG. 6 is a different cross-sectional fragmentary view showing the elements of the system as viewed along the line C-C in FIG. 2, looking the direction of the appended arrows.

This system thus efficiently heats or chills thermal transfer fluid with virtually maximum efficiency. Both the thermal transfer fluid and the refrigerant circulating in the tubing within it are closely interspersed and both move at whatever velocity is desired, without restriction. FIGS. 4, 6 and 7 show in the enlarged views particularly how the turns of the tube 20 have wedged firmly with line contact against the upper surfaces of the ridges 16 on the outside of the inner tank 14. FIGS. 4 and 7 also show that on the opposite side there is line contact between the tube 20 and the inner wall of the outer tank 12. This result is achieved without ultra-precise machining or selection of matching parts.

Figure 10:
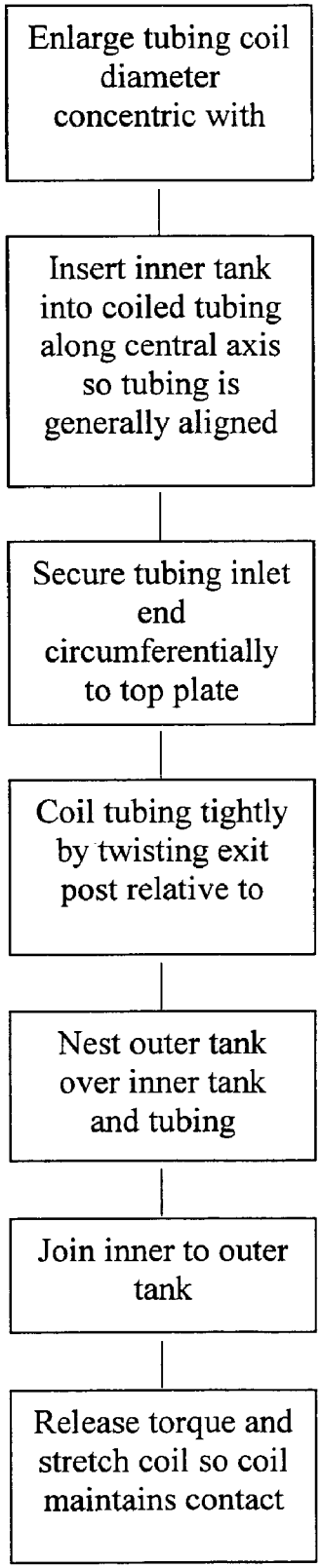
FIG. 10 is a flow chart of the steps of a method of assembling the helical refrigerant tubing and double cylinder combination of the system of FIGS. 1-9.

The method of assembly of this system so as to precisely fit the helical tubing 20 within the double walls of the volumetric housing 10 is illustrated in the steps of FIG. 10, and can better be visualized with the aid of the perspective views of FIG. 1 and FIG. 5. A tubing (e.g. copper tubing) of selected outer diameter, e.g. ¾" having some flexibility when unstressed is disposed in coil form concentric with a central axis. The partially loose coil is fitted over the inner tank 14 and seated loosely on the helical ridge 16. The top wall of plate 13 is then attached, with the inlet section 21 of the tube 20 fitted into an aperture in the plate 13 which fixes its circumferential position. Threaded studs 39 are vertically inserted into the plate 13, engaging the top turn of the tubing 20 and forcing it down onto the ridge 16. The tubing 20 having been circumferentially secured by the stiffened inlet section 21, the coil of tubing 20 is drawn downwardly, which radially compresses the coiled tubing 20 against the ridge 16. The inner tank 14, with the tubing 20 in position, is fed into the outer tank 12 concentric with the central axis, nesting into the volume of the outer tank 12 as the tanks 12, 14 are coaxially positioned. Then the tubing 20 is tensioned circumferentially, by exerting torque on the exit post 23 against the counteracting force from the fixed input end. This allows the outer tank to 12 to slide easily over the inner tank 14 and tubing 20. After this assembly, the coiled turns of tubing 28 are expanded by depressing the center tube 23 to force the tubing 20 to assume the predetermined pitch (p) spacing between the ridges 16 (FIGS. 4 and 7) on the surface of the tank 14.

The top rim of the outer tank 12 periphery may then be bonded to the outer tank 12, in the position seen in 7. The threaded studs 39 are tightened down onto the top tubing turn, holding the tubing in a reference position. The tubing system is held in the position shown in FIGS. 5, 6 and 7, and the assembly of major parts is thus concluded.

The flow of thermal transfer fluid through the system and the flow of refrigerant through the system may be reversed for specific applications. The pump for thermal transfer fluid may comprise any of a number of pumps although the Grundfos-type gradient pump is advantageous for its size and form factor. The heater element, as mentioned, need not be employed, but the flow tube provides an advantageous operating factor in assuring that the thermal transfer fluid fills the interior cavity of the heat exchanger between outer tank 14 and outer wall of center tank 12.

Figure 11:
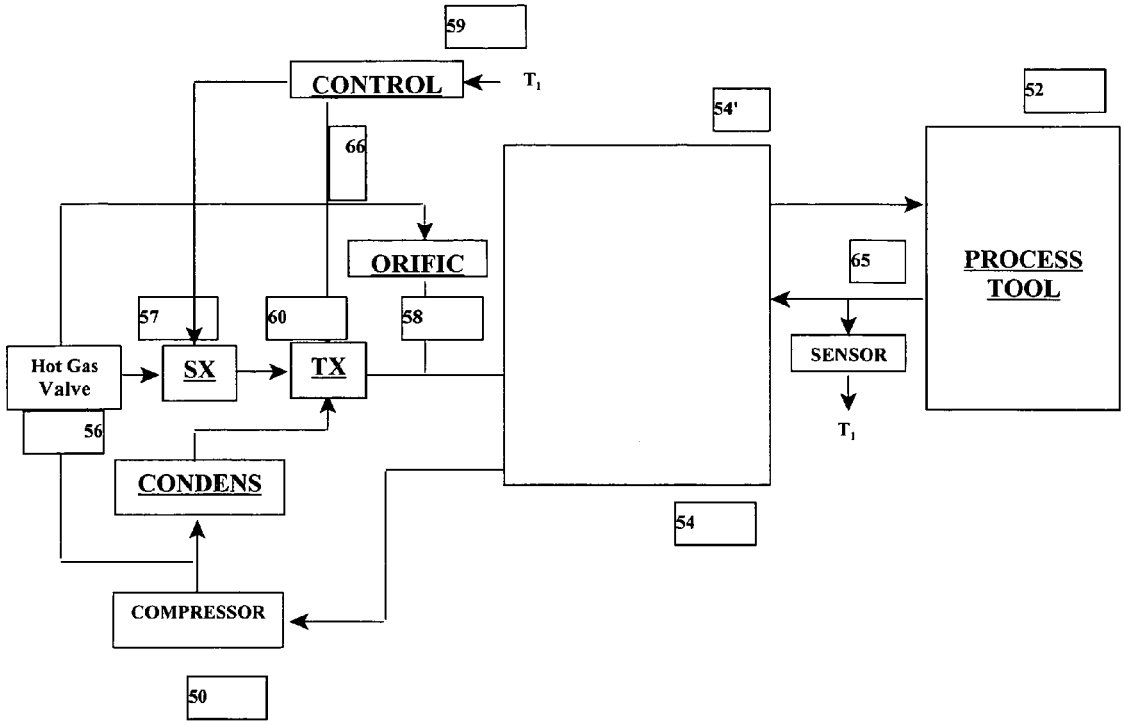
FIG. 11 is a block diagram of a thermal control unit for a process tool employing a heater exchanger as shown in FIGS. 1-9.

A thermal control unit that takes advantage of some of the potential of this heat exchanger is depicted in block diagram form in FIG. 11. As in a typical refrigeration mode control system, a compressor 50 cycles a refrigerant (say R507) in one loop while a thermal transfer fluid (say Galden) is directed internally to control the temperature of a process tool 52 after being heated (or cooled) by the refrigerant in a heat exchanger 54. In this instance the pump 54' and heater 54" shown in block form only in FIG. 11 are incorporated within the body of the heat exchanger 54, as previously described in conjunction with FIG. 1. The conventional refrigeration loop includes a condenser 56 cooled by an ambient fluid and a thermal expansion valve (TXV) 58. The valve 58 then feeds a temperature variable liquid/vapor mix, at a temperature as set by a controller 59 or operator, to determine the temperature desired for the process tool 52. In this mode the heat exchanger 54 may function as an evaporator, taking up heat to chill the thermal transfer fluid to a controlled level in accordance with the degree of vaporization and the pressure of the refrigerant.

In this configuration, in which the pump 54' feeds the process tool 52 after the thermal transfer fluid is chilled, some minor amount of refrigeration (or heating) capacity is lost in the fluid line. The small added increment of chilling power that is needed is more than compensated economically by the cost-advantages of the exchanger 54. Moreover a differently placed pump can always be used.

In a heating mode, the compressed hot gas from the compressor 50 bypasses the condenser 56 to a hot gas valve 57 as the TXV 58 is shut down and a shunt solenoid expansion valve (SXV) 60 is opened with a varying duty cycle to supply the hot gas to the heat exchanger 54 for temperature control. This proportional control greatly increases the temperature range at which the system can operate.

The controller 59 receives a signal ($T_1$) from a sensor 65 coupled to the output line from the process tool 52, and may receive pressure and temperature signals from other sensors (not shown) in the system, in conventional fashion. A bleed orifice 66 may be included to permit the release of air, if any, in the thermal transfer fluid as it circulates, but may alternatively be placed at other points. A bypass orifice can be included to allow some flow between input and output to insure pump cooling. As is well known, the controller 59 can operate in any one or more of a number of control modes, responsive to inputs from these or other transducers and sensors.

In the double tank system of FIGS. 1-9 low cost, readily replicable materials can be utilized, such as industrial plastics. These also have the advantage of low thermal conductivity, and allow the ridges 16 on the inner tank 14 to be made integral with the molded body. Metal materials, such as stainless steel, have also proven to be satisfactory.

Although various alternatives and expedients have been described, the invention is not limited thereto but includes all forms and variations within the scope of the appended claims.

The invention claimed is:

1. A compact, low cost heat exchanger comprising:

a double walled cylindrical element for receiving a thermal transfer fluid and including an internal cylindrical chamber and a gap between the walls;

a pump for the thermal transfer fluid including a pumping element immersed in the internal cylindrical chamber;

a fluid transfer system supplying thermal transfer fluid into the gap between the cylindrical walls; and a tubular system for transporting a temperature regulating fluid comprising a hollow tubular body helically wrapped with a selected spacing between turns of the helix about the inner wall in the gap between the walls of the double walled cylindrical element, and the tubular body contacting both walls of the cylindrical element for circulating the temperature regulating fluid about the periphery of the cylindrical element in heat exchange relation to thermal transfer fluid flowing in the gap within the spacing between turns of the helix.

2. A heat exchanger as set forth in claim 1 above, wherein the hollow tubular body comprises a tubing element wrapped with a pitch p within the gap and about the inner wall of the cylindrical element, the tubing element being of heat conductive material and having a diameter substantially less than the dimension of the gap between the walls, and wherein the cylindrical element further includes a helical ridge about the outside of the inner wall, the ridge having a pitch p for positioning the tubing element.

3. A heat exchanger as set forth in claim 1 above, wherein said tubular body about the outside of the inner wall engages both walls of the double walled cylindrical element in a line contact sealing relation such that both the thermal transfer fluid and the temperature regulation fluid flow in helical paths around the gap between the walls.

4. A heat exchanger as set forth in claim 3 above, wherein the cylindrical element comprises an interior cavity for receiving the pumping element, the gap between the walls is open to the interior cavity, and wherein the tubular system includes an inlet tube coupling to the hollow tubular body in the gap at one end and an outlet extension tube coupled to the other end of the hollow tubular body and extending through the interior cavity.

5. A heat exchanger as set forth in claim 4 above, wherein the double walled cylindrical element is configured as an outer cylinder concentric with a central axis and having an inner cylindrical wall concentric with said central axis and open at the bottom, and a top wall joined to both of the inner and outer cylinders.

6. A heat exchanger as set forth in claim 5 above, wherein said temperature regulating fluid comprises a refrigerant, and wherein the thermal transfer fluid operates between freezing and evaporation temperatures, and has flowable viscosity when in the liquid state.

7. A heat exchanger as set forth in claim 6 above, wherein said pump is mounted in the top wall of said cylindrical element and includes a centrifugal pumping element extending into said interior cavity within said double walled cylinder, and said heat exchanger further includes a bypass orifice disposed in the top wall, and said pump includes an outlet port above the top wall adjacent the pump and in communication with the interior cavity.

8. A heat exchanger as set forth in claim 6 above, further including a heater element mounted in said top wall and having a heater core within the interior cavity, a flow tube about the heater core extending from the bottom wall to adjacent the top wall, and an exit port proximate the top wall disposed about the pump.

9. A heat exchanger as set forth in claim 6 above, wherein the system further includes a fill tube for thermal transfer fluid that extends into the interior cavity in the double walled cylinder through an opening in the top wall, and a level sensor extending into the interior cavity.

10. A heat exchanger for heating or cooling and thermal transfer fluid with a refrigerant comprising:

a double walled tank having a central axis, for internally holding a thermal transfer fluid, there being a gap between the walls, the tank including an interior volume within the tank that is in communication with the gap, and containing thermal transfer fluid, there being at least one aperture between the gap and the interior volume;

a helical tubing disposed in the gap between the walls of the tanks and extending about the central axis, and physically contacting both walls to provide a helical flow path for thermal transfer fluid between the turns of the helical tubing along the direction of the central axis, and;

a thermal energy fluid source coupled to provide refrigerant flow within and through the helical tubing in thermal exchange with the thermal transfer fluid, wherein the exchanger provides constantly moving refrigerant and fluid in adjacent flow paths, and wherein the inner wall of the double walled tank includes a helical exterior ridge at a selected pitch, and the helical tubing is tensioned on the inner tank against the ridge in line contact.

11. A heat exchanger as set forth in claim 10 above, wherein the heat exchanger also includes at least one pump element and a heater extending into the interior volume from the top, wherein the double walled tank includes a top wall having apertures for refrigerant input and output, and apertures for thermal transfer fluid input and output.

12. A system for controlling the temperature of a thermal transfer fluid for use in a process tool comprising the combination of:

a compressor for receiving a refrigerant and providing a pressurized refrigerant of high enthalpy;

a condenser system for converting the refrigerant from the compressor to a pressurized refrigerant at substantially ambient temperature with a principal path;

a conduit system providing a high pressure gaseous refrigerant from the compressor in a bypass path;

a solenoid expansion valve system for providing controlled hot gas flow from the bypass path;

a thermal expansion valve for providing an expanded refrigerant at a selected temperature level from the condenser output on the principal path;

a volumetric heat exchanger having helically disposed, interspersed fluid flow paths for refrigerant and thermal transfer fluid and coupled to receive fluid from the bypass path and the condenser fluid path; and a controller system including controls for the flow in the bypass path and the principal path, for governing the temperature and enthalpy of the refrigerant.

13. A system as set forth in claim 12 above, wherein the volumetric system includes an interior volume for receiving a thermal transfer fluid, and the interior volume includes a fluid pump for the thermal transfer fluid, and the refrigerant is pumped by the compressor.

14. A system as set forth in claim 13 above including a heater element and a flow tube for providing flow through the volumetric heat exchanger in such manner as to fill at least a part of the interior about the heater element of the tank with thermal transfer fluid.

15. The method of assembling a heat exchanger having a hollow tubing wrapped helically within a circumferential gap between the walls of a double walled cylindrical tank about a central axis with the inner tank having a helical ridge of a selected pitch on the outer wall thereof, the tubing being disposed such that a fluid can be directed between the turns of the tubing without cross transfer of the fluid between adjacent turns comprising the temps of:

providing a helical tubular coil which when relaxed has a helical diameter greater than the inner wall component of the tank;

placing the relaxed tubular coil in approximate position over the outer wall of the inner tank component;

aligning the upper turn of the helical coil circumferentially and longitudinally on the inner tank component;

stretching the tubular coil along the central axis to reduce the helical diameter until the coil inner surface contacts the ridges on the outer wall of the inner tank;

inserting the inner tank component and helical tubular coil thereon within the outer tank component; and engaging the outer surface of the coil in sealing line contact with the inner surface of the outer tank component.

16. The method of assembling a heat exchanger in which cylindrical tank components are to be assembled with a predetermined radial gap between two cylindrical tank components when nested together about a central axis, one fluid in the thermal energy exchange to be flowed helically within a helical tubing in the gap and the other fluid to flow in the interspace between the turns of the tubing, comprising the steps of:

providing an inner cylindrical tank component having a helical ridge thereabout on the outer surface thereof, the ridge having an angled upper surface for receiving a surface of the helical tubing, and a pitch of predetermined spacing along the central axis, and a radial height relative to the central axis that is substantially less than the predetermined radial gap;

placing over the outer surface of the inner cylindrical tank component a helical heat conductive tube having a mechanically pliant radius relative to the central axis that is greater than the outer radius of the ridge on the outer wall of the inner tank component, the helical tube including an inlet port at one end and an output port extending along the central axis and having a tube diameter less than the predetermined gap size;

securing the inlet port of the tube from circumferential displacement while depressing the outlet port along the central axis to reduce the helical radius of the tube to contact the ridge on the outer wall of the inner tank component, with substantially the same pitch at the ridges;

placing an outer tank component above the inner tank component and helical tube;

stretching the tubing by circumferential movement relative to the inlet port, to establish line contact with the outer tank; and securing the tank components together with the helical tube in place.

* * * * *